US005387903A

United States Patent [19]

Cutter et al.

[11] Patent Number: 5,387,903

[45] Date of Patent: Feb. 7, 1995

[54] PROGRAMMABLE ELECTRONIC TIME LOCK

[75] Inventors: Larry Cutter, San Pedro; Klaus W. Gartner, Palos Verdes Estates, both of Calif.; Dieter Butterweck, Dortmund, Germany; P. Vuilleumier, Gletterens, Switzerland; Jean-Luc Monnier, La Chaux-de-Fonds, Switzerland; P.-A. Sermet, Marin, Switzerland

[73] Assignee: Ciposa Microtechniques SA, Switzerland

[21] Appl. No.: 874,191

[22] Filed: Apr. 24, 1992

[51] Int. Cl.[6] ..... E05B 43/00; E05B 49/00

[52] U.S. Cl. ..... 340/825.31; 70/271; 70/278

[58] Field of Search ..... 340/825.31, 825.3, 825.22, 340/309.15, 309.6; 341/35, 192; 368/10, 74; 70/267, 271, 272, 277, 278, 434, DIG. 45; 364/143-145

[56] References Cited

U.S. PATENT DOCUMENTS

| | | | |
|---|---|---|---|
| 4,376,993 | 3/1983 | Freeman et al. | 368/74 |
| 4,387,420 | 6/1983 | Singhi et al. | 364/145 |
| 4,774,512 | 9/1988 | Jolidon et al. | 340/825.31 |
| 4,875,351 | 10/1989 | Evans et al. | 70/271 |

FOREIGN PATENT DOCUMENTS

| | | | |
|---|---|---|---|
| 2205126 | 11/1988 | United Kingdom | 70/267 |
| WO86/05230 | 12/1986 | WIPO | E05B 43/00 |
| WO91/18168 | 11/1991 | WIPO | E05B 43/00 |

OTHER PUBLICATIONS

Undated Product Brochure of Seiko Epson Corp. of Tokyo, Japan for "SMC6281 Series CMOS 4-Bit Single-Chip Microcomputer".

*Primary Examiner*—Donald J. Yusko
*Assistant Examiner*—Edwin C. Holloway, III
*Attorney, Agent, or Firm*—Poms, Smith, Lande & Rose

[57] ABSTRACT

A programmable time lock includes a microprocessor, which senses the angular position of a key shaft via a sensor/encoder. The microprocessor includes ROM and RAM memory circuits, a timer, and a clock, and it can activate a stepper motor to control the position of a detent pin. The microprocessor is also connected to a display, which has fields for hours, minutes and seconds, as well as for the days of the week, for a cursor for each day, and for a low-power indicator. System time, as well as opening times for the lock may be set and changed simply by turning the key according to predefined routines. A method for operating the lock includes sets of steps for each of several routines: setting real time, setting opening times for each selected day of the week, and specialty routines including adding an intermediate opening time, cancelling the opening time for selected days, adjusting the system time, for example to change to or from daylight savings time, and verifying the version of the time lock in use. For all routines, the user first arms the lock by turning the key, and then selects a routine and enters the desired parameters by turning the key either continuously clockwise or counter-clockwise (to increment or decrement times or days) or by turning it back and forth to switch routines. In most routines, leaving the key stationary is used to signal acceptance of entered data.

4 Claims, 8 Drawing Sheets

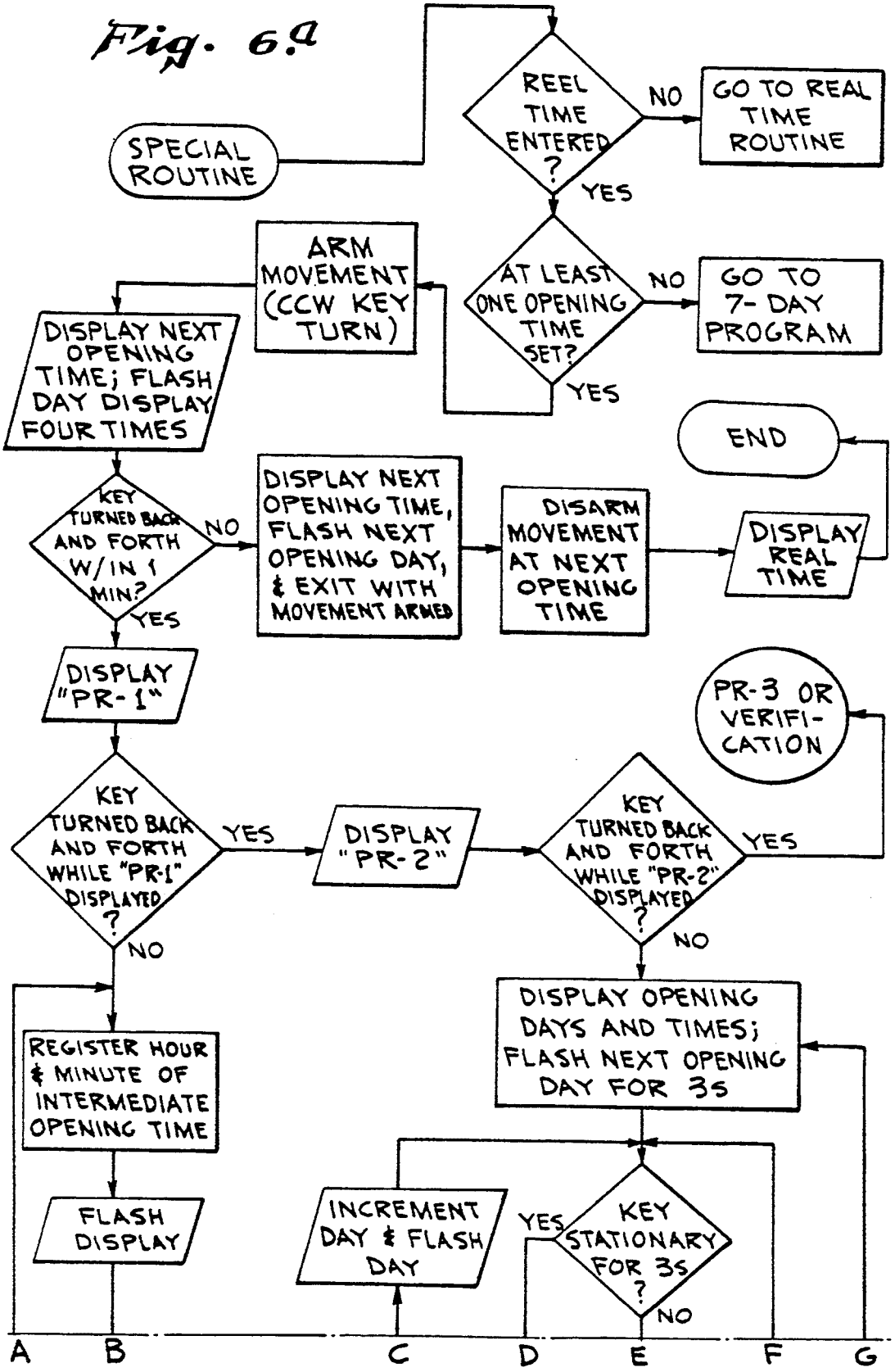
Fig. 6a
SPECIAL ROUTINE
REEL TIME ENTERED ?
NO
GO TO REAL TIME ROUTINE
YES
AT LEAST ONE OPENING TIME SET?
NO
GO TO 7- DAY PROGRAM
YES
ARM MOVEMENT (CCW KEY TURN)
DISPLAY NEXT OPENING TIME; FLASH DAY DISPLAY FOUR TIMES
END
KEY TURNED BACK AND FORTH W/IN 1 MIN?
NO
DISPLAY NEXT OPENING TIME, FLASH NEXT OPENING DAY, & EXIT WITH MOVEMENT ARMED
DISARM MOVEMENT AT NEXT OPENING TIME
DISPLAY REAL TIME
YES
DISPLAY "PR-1"
PR-3 OR VERIFI-CATION
KEY TURNED BACK AND FORTH WHILE "PR-1" DISPLAYED ?
YES
DISPLAY "PR-2"
KEY TURNED BACK AND FORTH WHILE "PR-2" DISPLAYED ?
YES
NO
NO
DISPLAY OPENING DAYS AND TIMES; FLASH NEXT OPENING DAY FOR 3s
REGISTER HOUR & MINUTE OF INTERMEDIATE OPENING TIME
FLASH DISPLAY
INCREMENT DAY & FLASH DAY
YES
KEY STATIONARY FOR 3s ?
NO
A
B
C
D
E
F
G

PROGRAMMABLE ELECTRONIC TIME LOCK

BACKGROUND OF THE INVENTION

1. Technical Field

This invention involves a programmable electronic time lock, especially for use in controlling the opening of vaults, and also a method for operating the lock.

2. Description of Related Art

Security is naturally of the utmost importance in the design of locking systems for such restricted access areas as bank vaults. There are accordingly a large number of mechanical and electro-mechanical locking devices. One problem with existing lock systems is that the more secure they are, the more complex they are, and authorized users are constrained by the locks either to accept fixed opening times, complicated time-changing procedures, or poor overview of the status of the lock.

Some devices have attempted to address certain of these drawbacks by taking advantage of more modern electronic and electro-mechanical components. Such existing electronic devices are disclosed in U.S. Pat. No. 4,875,351 (Evans et al., Oct. 24, 1991); PCT application PCT/EP36/00133 (Skye, S. A., published on Sep. 12, 1986 as WO 86/05230); and PCT application PCT/CH91/00111 (Ciposa Microtechniques, S. A., published on Nov. 28, 1991 as WO 91/18168).

The existing devices suffer from several additional disadvantages. First, the more modern, electronic time locks typically do not match existing mechanical movements with respect to size or mounting. As such, retrofitting more modern designs is either impossible or unduly expensive. Second, most existing designs do not allow the user to set the actual time or to monitor the actual time when the vault door is open. Third, existing lock systems do not allow the user to program opening times for a full seven-day week and to monitor the opening times; ideally, the locking system should display to the authorized user not only the status of all seven days of the weeks, but also the specific day and time of the next programmed opening.

One other drawback of existing lock systems is that they make it difficult or impossible to change opening times without completely resetting the mechanism. In order to accommodate temporary deviations from the normal opening routine, the user should be able to change the opening time within a given day, or to change the opening schedule for a given day of the week, without having to reset the main schedule for the system. This may, for example, be necessary on days in which the bank is to open later than normal, or when the bank will not be opening at all because of a holiday. Furthermore, the lock system should be able to accommodate changes to and from "day light savings time" or "summer time" without the user having to reset the entire schedule by one hour. Accordingly, it should be possible to change the real time setting of the system by plus or minus one hour and 59 minutes (for most countries, only one-hour changes are ever required).

The object of this invention is to provide a programmable time lock that avoids the shortcomings and provides the needed features mentioned above.

SUMMARY OF THE INVENTION

The programmable time lock according to the invention includes a microprocessor, which senses the angular position of a key shaft via a sensor/encoder. The microprocessor includes or is connected to ROM and RAM memory circuits, a timer, and a clock. A stepper motor is connected to the microprocessor, which can activate the stepper motor to control the position (armed/disarmed) of a detent pin. The microprocessor is also connected to a digital display, which has display fields for hours, minutes and seconds, as well as for the days of the week, for a bar-segment cursor for each day, and for a low-power indicator. System time, as well as opening times for the lock may be set and changed simply by turning the key according to predefined routines.

The invention also includes a method for operating the programmable lock, with the method including sets of steps for each of several routines: setting real time, setting opening times for each selected day of the week, and specialty routines including adding an extra opening time for the current day, cancelling the opening time for selected days, adjusting the system time, for example to change to or from daylight savings or summer time, and verifying the version of the time lock in use. For all routines, the user first arms the lock by turning the key, and then enters the selected routine and the desired parameters by turning the key either continuously clockwise (CW) or counter-clockwise (CCW) (to increment or decrement times) or by turning it back and forth to switch routines. In most routines, leaving the key stationary is used to signal acceptance of entered data.

DETAILED DESCRIPTION

The time lock according to the invention is described below with reference to its use in a bank vault. The invention may, however, be used in any other application in which a versatile time lock is needed to control and change the opening times for a secure structure.

Figure 1:
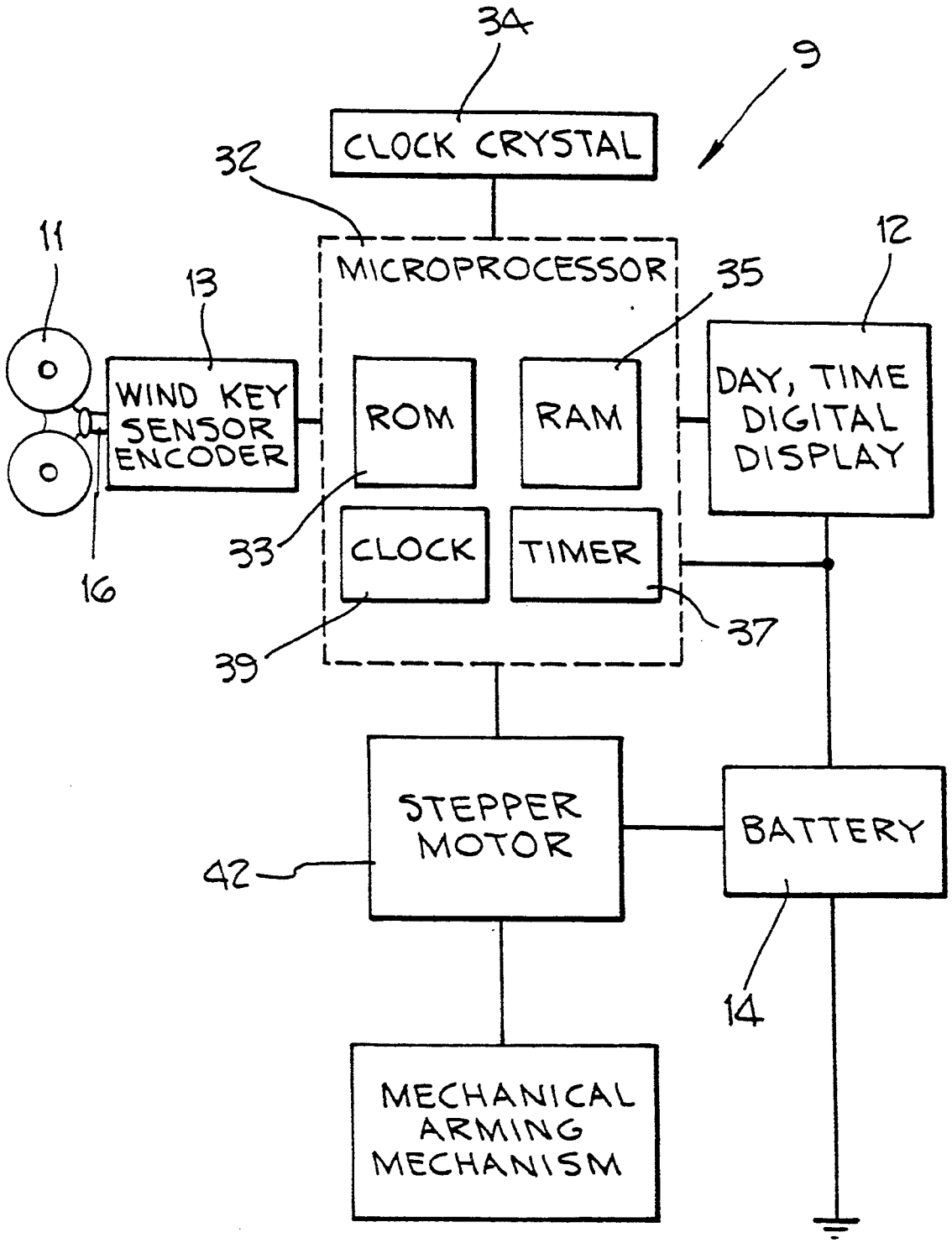
FIG. 1 is a simplified block diagram of the invention.

FIG. 1 is a greatly simplified block diagram of the programmable lock 9 according to the invention. A wind key 11 is mechanically connected to a key sensor/encoder 13, which senses the angular position of the key shaft 16 relative to a mechanically predetermined null position.

The sensor/encoder 13 is electrically connected to a microprocessor 32, which preferably includes both read-only (ROM) 33 and read/write (RAM) 35 memory circuits, as well as a timer 37 and a clock 39, which derives a time base signal from an externally connected clock crystal 34 or other timing circuit. In the preferred embodiment, the ROM 33, the RAM 35, the clock 39 and the timer 37 are manufactured in the same capsule as the microprocessor 32, preferably as a single integrated circuit, but it is also possible to include them as separate circuits that are attached to the microprocessor 32 in a conventional manner. The system also includes a source of electric voltage 14, preferably in the form of a battery, which is mounted in a holder on the casing 10 of the lock (see below).

The microprocessor 32 is electrically connected via a conventional bus arrangement 38 to a digital display 12, which is preferably an LCD-display with a series of display fields, including fields for displaying the days of the week, hours, minutes and seconds, as well as fields for system signals such as an indicator (for example, shaped as a small battery) to warn the user that the system voltage is low and that it is time to replace the battery. The microprocessor 32 is also electrically connected to a stepper motor 42, electric latch mechanism or the like in order to control the position of a mechanical locking device such as a detent pin 18 (see below).

Figure 2:
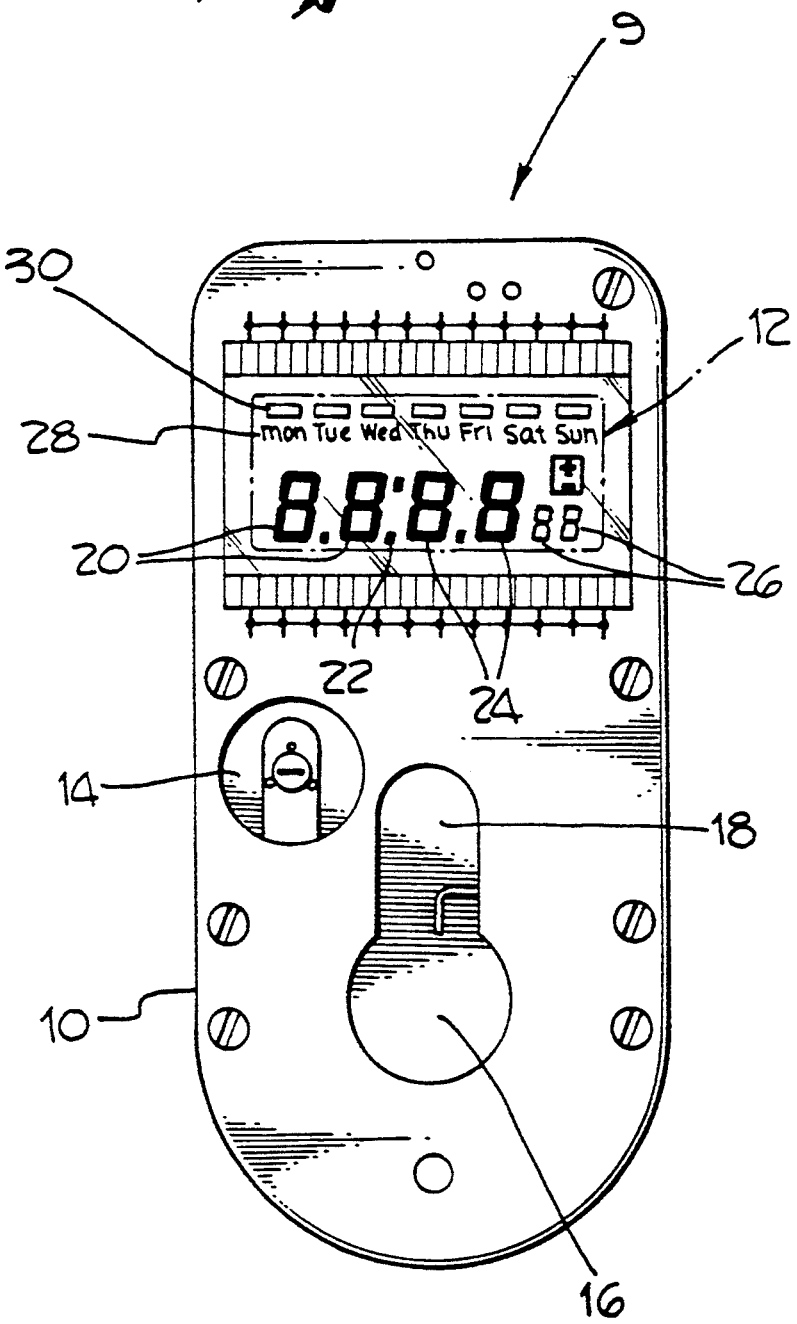
FIG. 2 illustrates the front panel and display of a time lock according to the invention.

As FIG. 2 shows, the time lock 9 according to the invention preferably includes a casing 10, in which a display 12 is mounted. At least one battery 14 is provided, preferably mounted so that it can be replaced without having to remove the casing 10 from the vault door. One should note that when the invention is used in a bank vault door, it will typically be mounted on the inside of the door. As such, access to the time lock 9 is only possible when the vault door has already been opened. Unauthorized persons will therefore never be able to see the display 12, at least not when the vault door is closed.

A key shaft 16 preferably extends from the casing 10, as does a rotating or sliding detent pin 18. The shaft 16 is preferably slotted or shaped to receive a wind key 11 (not shown), by means of which the user, as is described below, can set and change the real time and opening times for the lock. Such a mechanism is sold as the Models 124 and 134 by Ciposa Microtechniques of Saint-Blaise, Switzerland.

As is mentioned above, the microprocessor is also electrically connected to a stepper motor 42 or an electrically operated catch, which releases the detent pin 18 when the lock 9 is to be disarmed. The time lock according to the invention preferably contains spring-biassed works that are wound up in order to arm the lock. Preferably, the user arms the lock by inserting the wind key 11 onto the shaft 16 and turning it until the spring-biassed works are wound up and latched in the armed position. Activation of the stepper motor 42 by the microprocessor 32 can then release the latch, whereby the detent pin 18 moves to its disarmed position under the influence of the previously wound-up spring; this reduces battery usage, since it requires much less energy simply to release an armed mechanism than it does to have to use the stepper motor 42 to arm the lock against the force of the spring.

One of the advantages of the invention is that the casing 10 can be shaped to fit the mounting brackets or recesses for conventional locks on vault doors. The single-key 11 control and programming feature of this invention makes it even easier to replace existing lock systems, which often have a single keyhole for purely mechanical access to the works of existing mechanical time locks.

The display 12 is preferably a liquid-crystal diode (LCD) display with two digits 20 for hours, a flashing colon separator 22, two minute digits 24, and two second digits 26. Additional separators such as decimal points may also be included. The display also includes day-of-the-week indicators 28, and a cursor or bar segment 30 adjacent to (preferably just above) each day indicator 28. The day indicators 28 may be in any language, and one should note that the seven cursor or bar segments 30 can be turned on and off individually.

The key shaft 16 is connected to a series of internal electrical contacts formed as switches, whereby movement of the key 11 in either direction is sensed by the internal circuitry of the time lock. This is described in more detail below.

The detent pin 18 is actuated by a stepper motor 42 (see below) and can rotate between an open position and a locked position. In most applications, the detent pin 18 will connect with and actuate other locking arms, pins, and wheels that control the movement of the locking bolts in the vault door. Such linkages and arrangements are well known.

Figure 3:
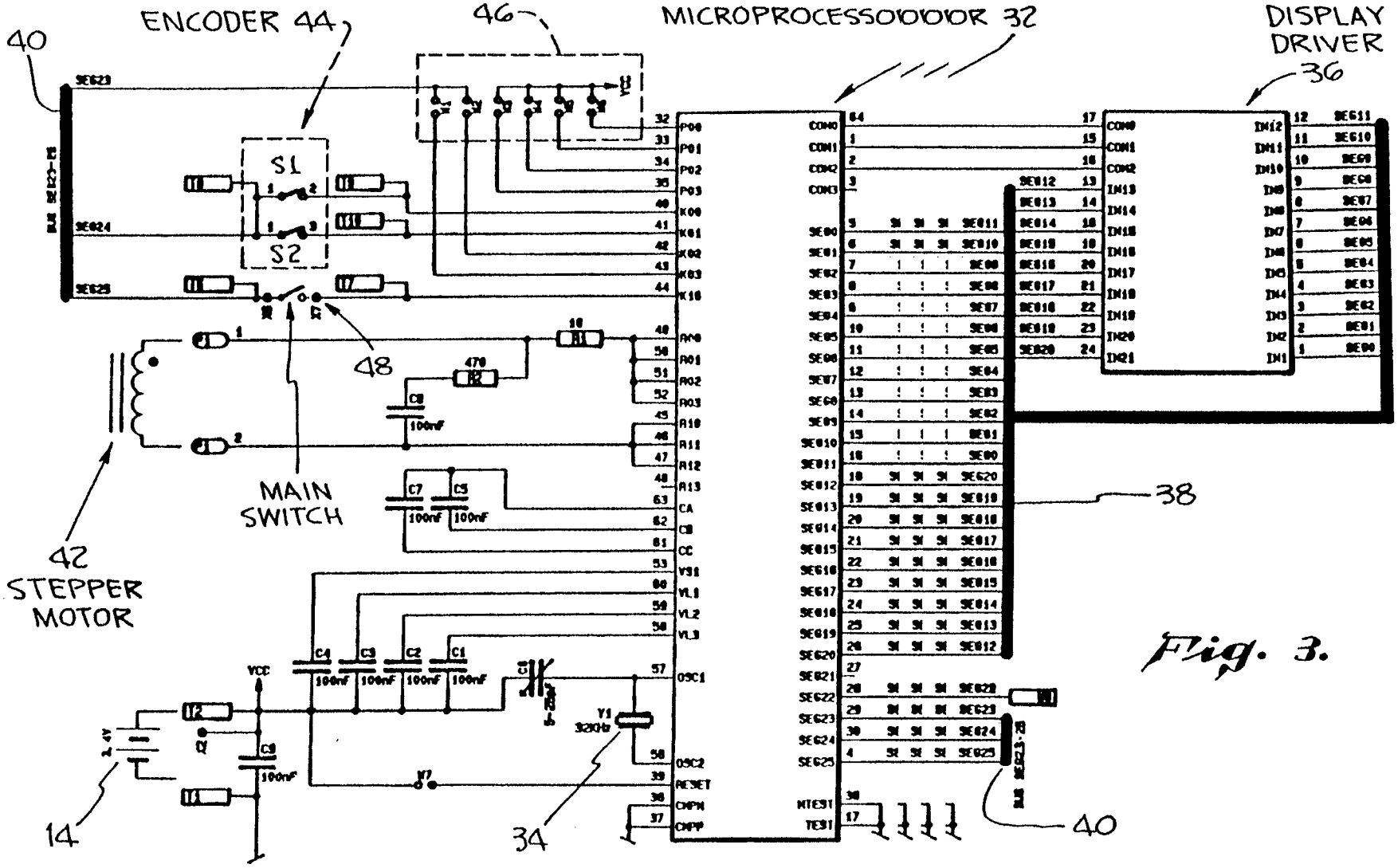
FIG. 3 is a circuit diagram that illustrates one electronic configuration for the time lock.

FIG. 3 illustrates the main electronic and electrical components of the time lock according to the invention. The time lock includes a microprocessor 32 and a timing device such as a crystal 34, which is connected to the microprocessor 32 in a known manner. The battery 14 supplies electrical current to the microprocessor 32 and, via contacts VCC, to the other electrical and electronic components in the system.

A display driver 36 is preferably connected to the microprocessor 32 via a main bus 38. The display driver 36 converts segment display commands from the microprocessor 32 into segment control signals that activate the various segments of the display 12 (see FIG. 2). Other segments of the display 12 may be driven directly by the microprocessor 32 via further lines or a smaller bus 40. The arrangement of a display driver between a display and a controlling processor is known in the art and is not described further.

Via conventional passive components, the processor 32 also controls a stepper motor 42, which in turn drives the retaining pin 18 (see FIG. 2).

An encoder 44 is also connected electrically with the microprocessor 32. The encoder includes at least two switches S1, S2. The switches S1, S2 are preferably arranged as an encoded disk with conductive surface leads and conventional commutation such that the closing of each switch represents rotation of the key shaft 16 to either side of a null position. The system preferably also includes positional switches 46 by means of which the processor is able to interpret the angular position of the key shaft relative to its null position. A main switch 48 is preferably also included to indicate to the processor 32 when the key shaft is first rotated, indicating that it is to enter an armed mode.

The position and movement of the key shaft may also be encoded using standard calibrated potentiometers or other devices. If analog encoders are used, a suitable analog-to-digital converter should be provided either between the encoding device 44 and the microprocessor 32, or within the microprocessor 32 itself. The conversion of the rotary motion of a device such as the key shaft 16 to signals that can be interpreted by a digital processor is well known and is not described further.

Many types of microprocessors are suitable for use in the invention. In a functioning model of the invention, however, a CMOS four-bit, single-chip microcomputer in the SMC 6281 series by the Seiko Epson Corporation was used. This microprocessor includes an internal 1 k×12 internal ROM memory, operates as a four-bit core CPU and has low power consumption with a 32 kHz working frequency. In addition to the ROM memory, this microprocessor also includes a 96×four-bit internal RAM memory, an LCD driver circuit, a time-base counter, and a stop watch counter. Other microprocessors with external ROM and RAM memory circuits may also be used, although the integrated microcomputer used in this preferred embodiment reduces the space required for mounting the circuit within the casing 10 of the time lock 9.

As is well known, the program used to control the microprocessor may be pre-stored in the internal ROM memory at the time of manufacture. Alternatively, external erasable (such as EPROM circuits) or non-erasable ROM memory circuits could be attached to the processor 32. By using external memory circuits to contain the program that controls the microprocessor, the program of the time lock according to the invention may be customized, updated or changed to fit the needs of a particular user without having to replace the entire lock system.

The user of the lock system according to the invention is able to communicate with the microprocessor 32 by turning the key shaft 16 with the key (not shown). In the preferred embodiment of the invention, the microprocessor 32, via the key shaft 16 and encoder 44 and position switches 46 senses the following key shaft states:

1) a stationary state, in which the key shaft is substantially not being rotated;

2) the arming state, in which the key shaft is turned, for example, counter-clockwise beyond a mechanically or electrically predetermined arming position;

3) counter-clockwise (CCW) rotation of the shaft;

4) clockwise (CW) rotation of the shaft; and

5) "back-and-forth" shaft rotation, that is, a series of CW and CCW rotations within a predetermined time period (this state is a combination of state changes within the time period between states 3 and 4).

Since the microprocessor 32 is connected to a crystal or timing device 34, the microprocessor 32 can determine the time during which the key shaft is in any given state either by sensing the timing device directly, or by indirect methods such as setting an internal counter with intervals corresponding to a predetermined number of machine cycles.

The programmable time lock according to the invention preferably operates in any of the following modes:

1) real-time mode, in which the real system time may be set and viewed;

2) seven-day setting mode, in which the user may enter an opening time (not necessarily the same) for each day of the week, omitting those days on which the lock is not to open at all;

3) intermediate opening mode, in which the user can set an one-time opening time for a given day in addition to the normal opening time for that day;

4) cancellation mode, in which the user cancels the programmed opening time on any one or more of the next six calendar days;

5) "daylight savings" or "summer time" mode, in which the user is able to change the real time setting by plus or minus one hour and 59 minutes; and 6) verification mode, in which the processor activates the release mechanism (for example, the detent pin 18) and move it, via the stepper motor 42, to the disarmed position.

The following description explains the preferred method of operating the time lock according to the invention for the various modes.

REAL TIME MODE

In order to avoid the possibility of confusion and incorrect programming, although the display 12 includes display segments 30 for all seven days of the week, only one day is preferably displayed at any time as the real time is being set and when real time is being displayed. Also, in order to simplify setting real time, and since accuracy of opening times to less than a minute are seldom required, preferably only the hours and minutes are set during the real time mode.

Figure 4:
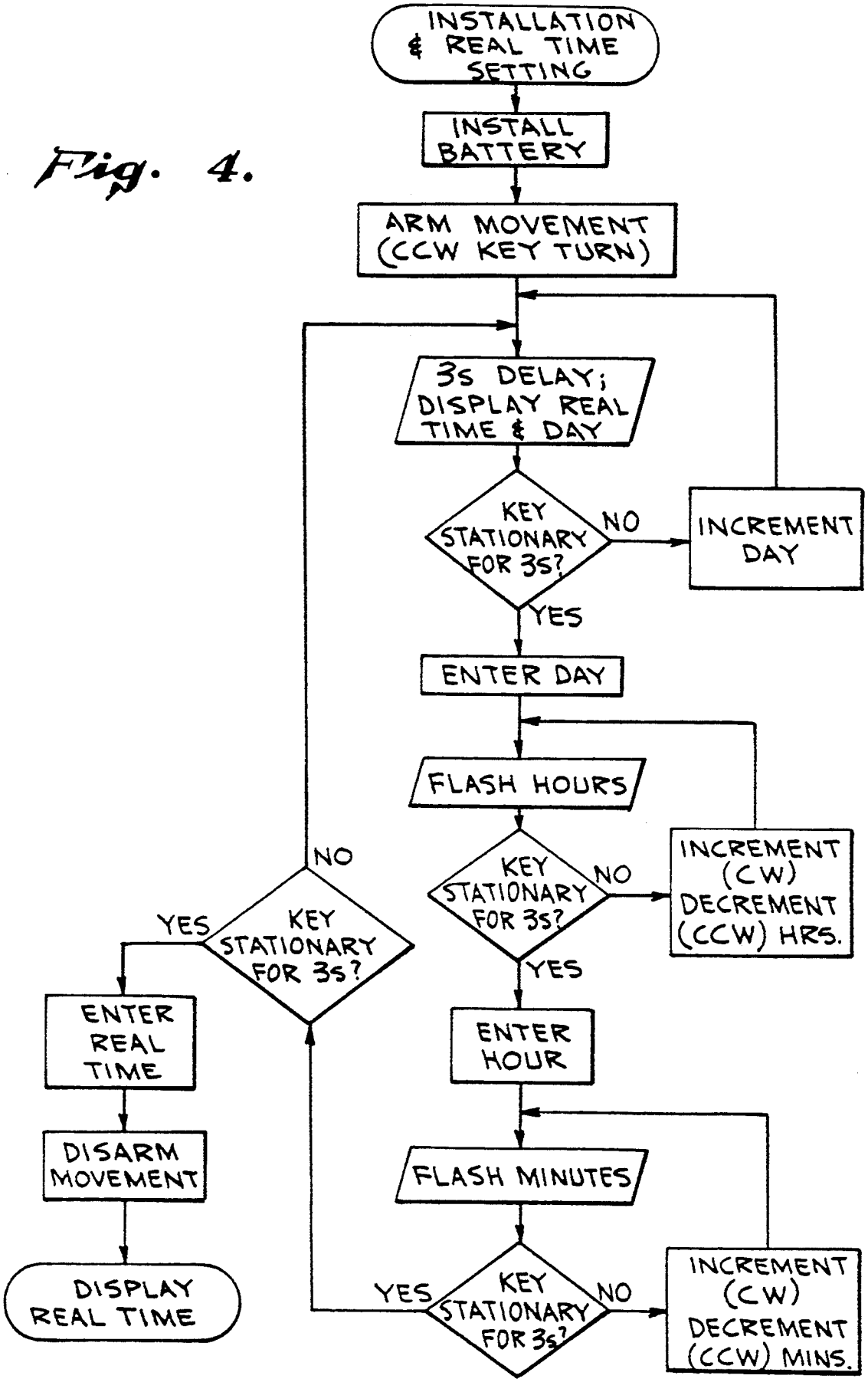
FIG. 4 is a flowchart of a procedure for setting the real time clock of the programmable lock according to the invention.

The preferred steps for initially setting real time are as follows, and are given on the flowchart FIG. 4:

1) Upon installation of the batteries, the complete display will appear as in FIG. 2.

2) Insert and turn the key CCW until the movement is armed, and then leave it stationary for a mode activation period on the order of a few seconds; in a prototype of the invention, a three-second stationary period is used. Upon sensing arming and after the three-second stationary period, the microprocessor 32, via the driver 36, causes the display 12 to display an initial real time display (such as Monday, 00:00:00). After an period of approximately three seconds (or some other predetermined stationary period) more, the graphics for, for example, Monday, will begin to flash at a predetermined frequency on the order of twice a second. After arming, the wind key must remain in a stationary position to initiate the flashing graphics for that day.

3) To set the day:

If Monday is the correct day, the user holds the wind key in the stationary position and after the stationary period the day indicator is displayed as solid, indicating that the processor has entered "Monday" as the correct day. If Monday is not correct, the user turns the wind key in either direction during the flashing cycle until the proper day is displayed; the microprocessor 32 displays different days 28 depending on the angular position of the key shaft 16. When the microprocessor 32 senses that the wind key is stationary for the stationary period, it enters the selected day into its program memory.

4) To set hours:

After the microprocessor 32 enters the selected day, it indicates entry by directing the display 20 to flash. As the display 20 flashes, the user turns the wind key, until the proper hour 20 is displayed; the processor increments or decrements the hour 20 displayed depending on the angular position of the key shaft 16. When the microprocessor 32 senses that the wind key 11 is stationary for the stationary period, it enters the selected hour 20 into its program memory.

In setting the hour, turning the wind key CCW during the flashing cycle for example decreases the value of the number displayed by the hour segments 20, whereas turning the key CW increases this value. The ability to increase or decrease the value of the number displayed through the direction the key is turned is preferably consistent in all program procedures.

5) To set minutes:

After the hour 20 has been selected and entered the minute indicators 24 preferably begin to flash. The user then follows the procedure outlined above for setting the hour. After the microprocessor 32 enters the value for minutes, it preferably enters "00" as the value of seconds.

After the day, hour, and minutes have been entered and are displayed on the display 12, the microprocessor 32 causes the display 12 to flash for a verification period, which is preferably longer than the three-second stationary period, for example, approximately fifteen seconds, after which the display 12 becomes solid (non-flashing). During the flashing period, movement of the key restarts the program or at least the current program segment (such as setting minutes). After entry, the microprocessor 32, via the stepper motor 42, disarms the lock.

If the real-time mode is restarted, the previously entered time is preferably displayed. Also, the real time must be entered, that is, the above sequence 1)–5) must be completed, before the lock according to the invention will accept other programmable features. If no value for hours and minutes is entered after the day has been selected, the microprocessor 32 will preferably enter "00:00" as the real time. Furthermore, upon power-up of the system, for example, after the battery 14 is removed and replaced, the microprocessor 32 preferably automatically sets real time to a "zero" value such as "00:00:00".

SEVEN-DAY SETTING MODE

Figure 5:
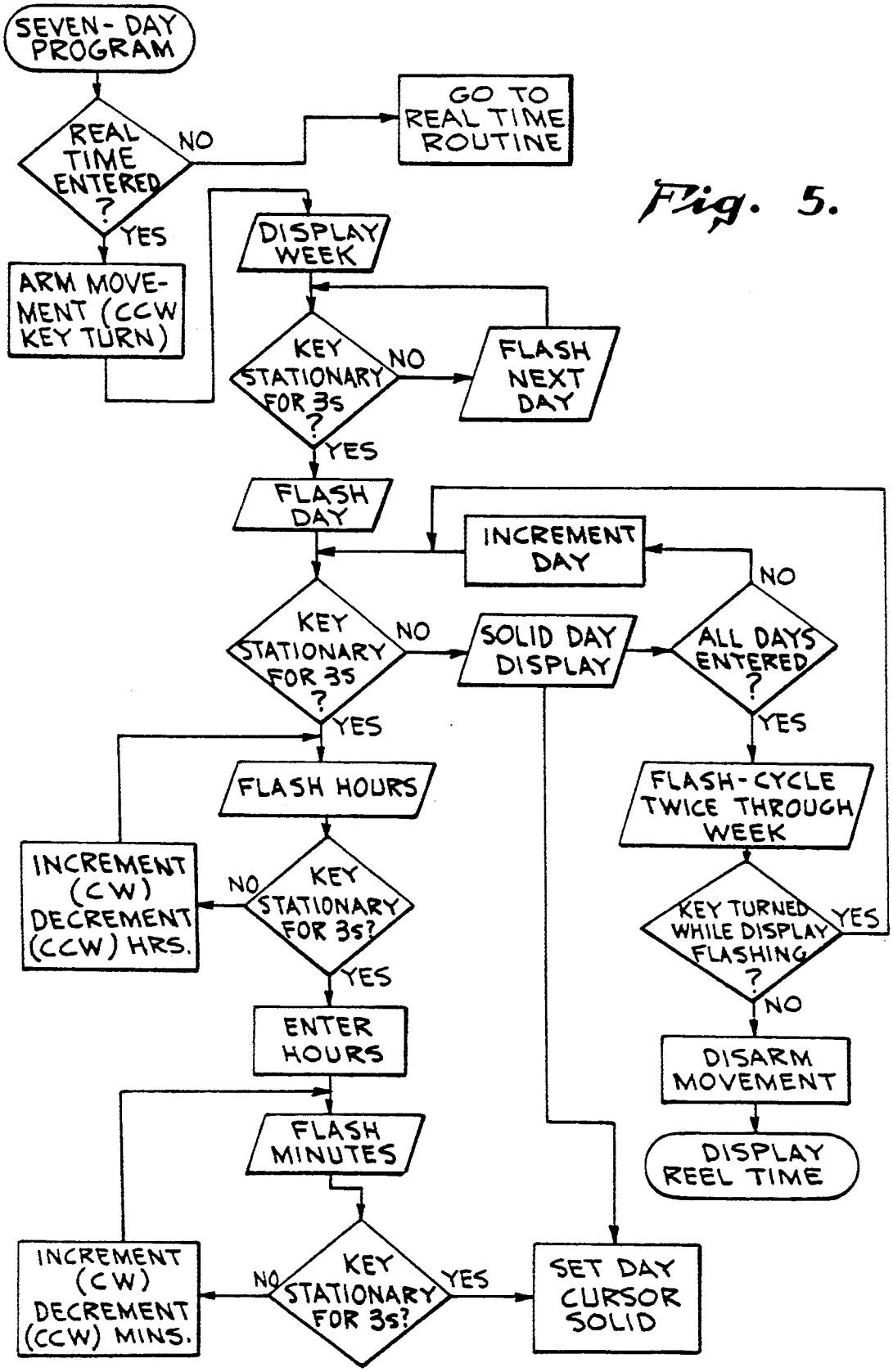
FIG. 5 is a flowchart of a procedure for setting opening times for the lock for any or all of the days of the week.

The preferred steps for setting the opening times for the lock for the various days of the week are as follows, and are given on the flowchart FIG. 5:

1) After real time has been entered, the user rearms the movement, whereupon the microprocessor 32 preferably directs the display 12 to display a standard week display, in which all of the day-of-the-week segments 28 are activated, and the time is shown as "00:00". (Display of seconds is not normally necessary and is preferably omitted to avoid confusion and simplify programming).

2) The user holds the wind key in the stationary position for the stationary period, whereupon the processor flashes the segment indicator 28 for Monday (Mon). If the key 11 is turned during the flashing period, the processor enters that no opening time is required for Monday, the microprocessor 32 causes the "Mon" segment to be displayed solid, and it causes the display 12 to flash the segment indicating the next day, that is, Tuesday ("Tue").

If the user wishes to enter an opening time for Monday, however, the user does not turn the key 11 as "Mon" is flashing, and after the end of this flashing period the microprocessor 32 causes the hour indicators 20 to flash. The hour is then entered by turning the key 11 in the same manner as for entering real time. When the desired opening hour is displayed, the user leaves the key 11 stationary for the stationary period, and the microprocessor 32 then causes the minute indicators 24 to flash. The user then enters the desired opening minute by turning the key 11; the microprocessor 32 enters the minute that is shown on the display 12 when the key has been left stationary for the pre-determined stationary time.

3) After the hours 20 and minutes 24 have been entered, the user holds the key stationary and the minute indicators 24 become solid. The microprocessor 32 then activates the corresponding bar segment 30 above the day. If an opening time is selected for a given day, the user can therefore tell at a glance on which days of the week the lock is programmed to open.

When selecting an opening day, when the user moves the key 11, the microprocessor 32 will cycle to the next day, flash the corresponding segment for the predetermined selection or adjustment period, preferably about three seconds, and allow entry of an opening hour and minute in the manner just explained. If no opening time is chosen for any day, the day-of-the-week indicator 28 for that day is displayed solid, but without any solid bar 30 above it.

4) In order to give the user the opportunity to confirm entry of the correct opening times, after the routine entry of opening times has been run through, the processor causes the display to flash through the daily entries (Mon through Sun), preferably twice, after which the processor disarms the movement and causes real time to be displayed once again. If corrections are necessary, turning the key during the scanning cycle will re-start the routine for setting opening times program with the day being verified at that time and allow corrections. Note that at least one of the seven days must be assigned an open time.

SPECIALTY ROUTINES

Figure 6B:
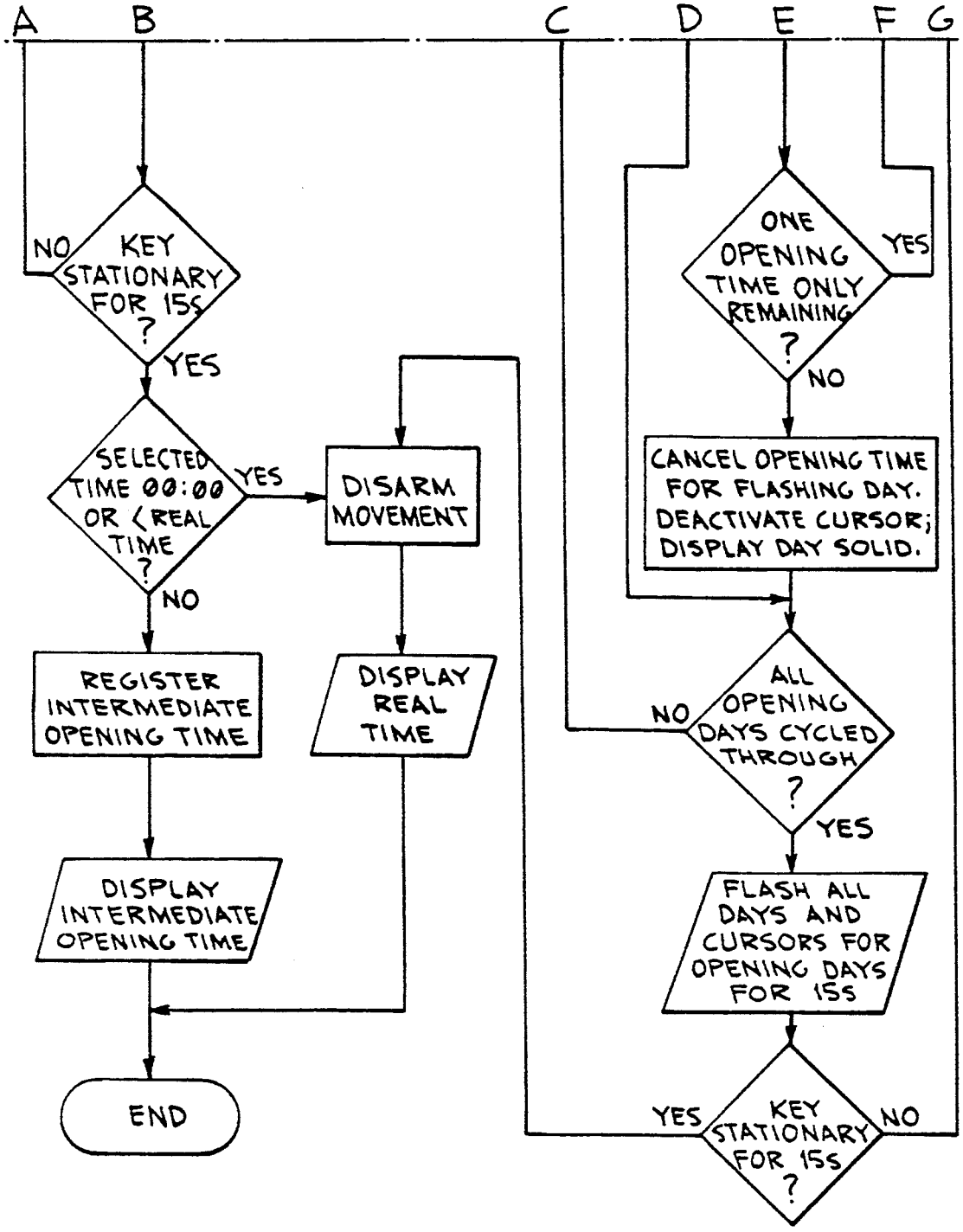
FIGS. 6(*a*)–(*b*) and 7 are flowcharts of procedures for activating and setting specialty features of the programmable lock according to the invention.
Figure 7:
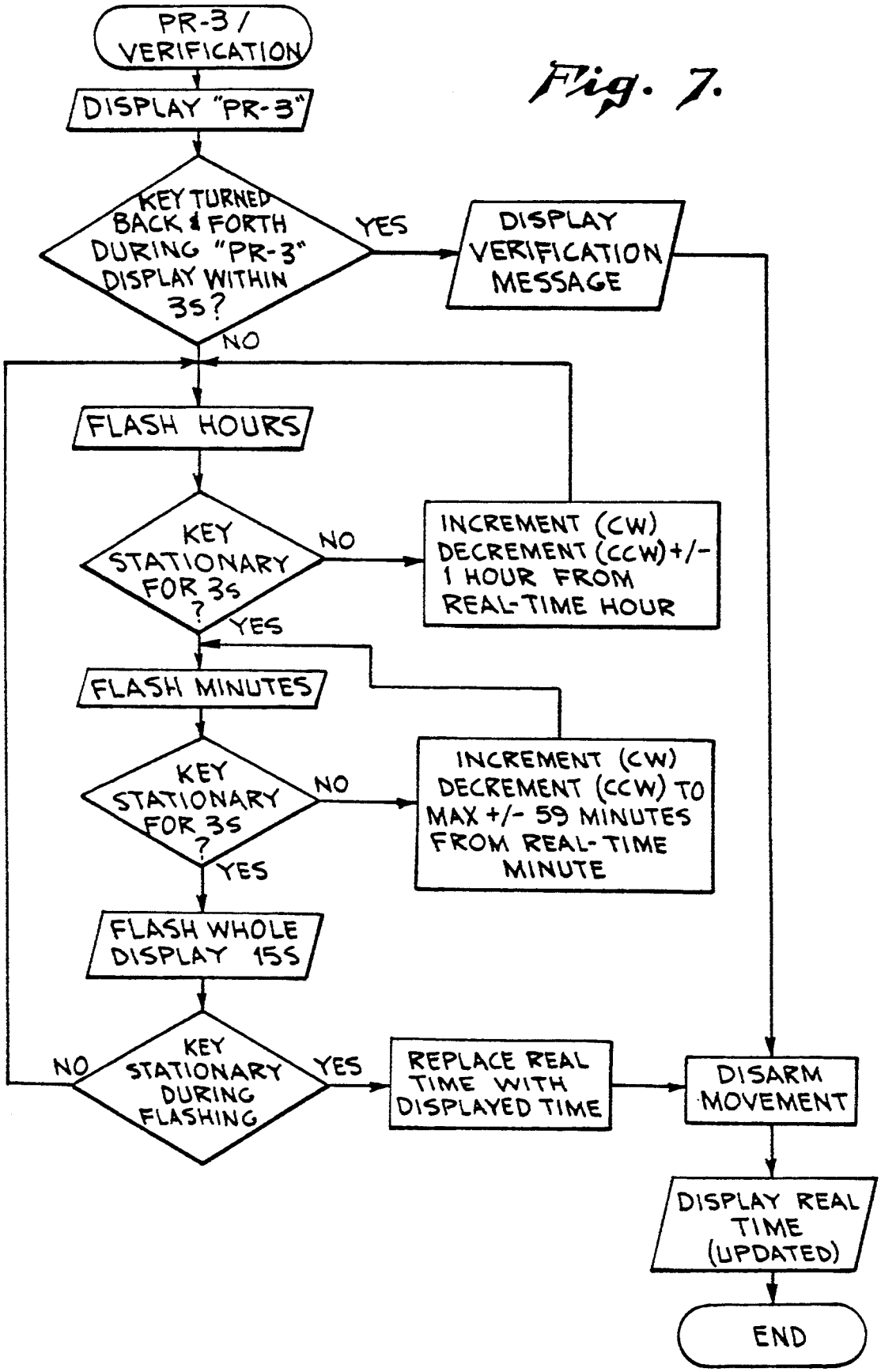

The invention provides the user the ability to alter and check the preset opening program without requiring full reprogramming of the lock. These specialty routines include the ability to set an intermediate opening time for the lock for a current day, to cancel the opening of the lock for any given opening day (for example when the day will be a holiday), to adjust the real time to accommodate daylight savings or summer time, and to verify which version of the lock is installed. The preferred steps for these various specialty routines are described below, and are illustrated on the flowcharts FIGS. 6(a)–(c).

Intermediate Opening Mode

This feature is provided to allow the user to set one opening time within a current day. The steps involved are as follows:

1) The user turns the wind key 11 CCW to arm the movement, whereupon the microprocessor 32 causes the display 12 to display the next opening time (the day indicator and time will preferably flash).

2) With the wind key 11 held stationary, the user waits until the microprocessor 32 directs the display 12 to flash the day indicator a predetermined number of times, for example four times, after which the user turns the wind key 11 back-and-forth until a predetermined graphics message, for example "PR-1" is displayed.

3) The user then holds the wind key 11 stationary for the standard stationary period as above, whereupon the microprocessor 32, upon sensing this, causes the graphics for hours 20 and minutes 24 to be displayed and the hour graphics to begin to flash.

4) The user then follows the procedures explained above for setting hours, after which the microprocessor 32 causes the minute graphics 24 to begin to flash.

5) The user then follow the procedures explained above for setting minutes.

6) After both hours 20 and minutes 24 have been entered the microprocessor 32 causes the display 12 to flash for the verification period, preferably approximately fifteen seconds, after which the hour 20 and minute 24 graphics will become solid and the colon cursor 22 between the hour 20 and minute 24 indicator segments will flash, indicating that the time has been entered. During the fifteen-second verification period, movement of the key will restart the program, and if the time selected is before the actual real time, the microprocessor 32 preferably disarms the movement automatically.

Cancellation Mode

This feature is provided to allow the operator to cancel the programmed opening time on any one or more of the next six calendar days, for example in anticipation of a holiday that falls on a day when the vault normally would be opened. The method of putting the system in this mode follows these steps:

1) The user turns the wind key 11 counter-clockwise to arm the movement; the microprocessor 32 causes the next opening time to be displayed.

2) After the wind key 11 is held in the stationary position for the stationary position, the microprocessor 32 flashes day indicator 28, for example, four times; the user then turns the wind key 11 back-and-forth. Upon sensing this back-and-forth motion, the microprocessor 32 causes the first graphics message "PR-1" to be displayed, but the user continues to turn the key 11 back-and-forth for a predetermined period, after which the microprocessor 32 causes a second graphics message, for example "PR-2" to be displayed.

3) The user holds the wind key 11 in the stationary position for a predetermined delay period, after which the microprocessor 32 causes a cancel display 12 to be displayed. The cancel display 12 preferably flashes the day 28 with the next scheduled opening time, along with the bar segment cursor above that day.

4) If no change is required for the day indicated (graphics flashing), the user holds the wind key 11 in the stationary position for the delay period, for example, approximately three seconds. The microprocessor 32 then directs the display 12 to show the day initially indicated as solid (not flashing), and then to flash the next day assigned an opening time.

5) If the opening time for the day indicated is to be canceled, the user turns the wind key 11 during the flashing cycle, after which the microprocessor 32 causes the day indicator 28 to be displayed as solid and the bar segment cursor above the corresponding day to disappear.

6) The user repeats the procedure for each programmed day of the week, after which the modified display will flash for the approximately 15-second verification period. If the user moves the wind key 11 during this verification period, the microprocessor 32 restarts the cancellation routine. The microprocessor 32 will not allow cancellation of the last remaining opening time. After verification, the microprocessor 32 disarms the movement.

Note that at least one day must be left with an opening time. Also, for certain application, it may be desirable for the microprocessor 32 not to allow the user to cancel the next scheduled opening for the current day.

Daylight Savings Mode

This feature is provided to allow the user to adjust the real time by adding or subtracting up to one hour and 59 minutes from the Real Time Display. The procedure for this feature is as follows:

1) The user turn the wind key 11 counter-clockwise to arm the movement, after which, as before, the display 12 for the next opening time will appear.

2) The user holds the wind key 11 stationary until the day indicator 28 has flashed four times, and then continues to turn the key 11 back-and-forth. As before, "PR-1" is first displayed, and then "PR-2" and when the processor senses that the key is being turned back-and-forth while "PR-2" is displayed, it switches into the daylight savings mode, and causes the display 12 to display, for example "PR-3" indicating to the user that it has entered the daylight savings mode.

3) The user holds the wind key 11 stationary until the real time display appears and the hour 20 indicator begins to flash. During the flashing cycle, the operator turns the key either CW or CCW, at which the microprocessor 32 updates the real time by plus or minus one hour, respectively.

4) After the hours have been entered, the user holds the wind key 11 stationary, at which the microprocessor 32 causes the minute 24 indicators to flash. The user then follows the follow the procedure explained above for setting minutes.

5) After the real time has been updated, the microprocessor 32 causes the display 12 to flash for the verification period (preferably approximately fifteen seconds) and then disarms the movement. During the flashing verification cycle, if the operator turns the wind key 11, the microprocessor 32 restarts the routine.

Verification Mode

This feature is provided to allow the user to check the configuration of the system and to check that the movement release mechanism is functional. The procedure for this feature is as follows:

1) The user turns the wind key 11 counter-clockwise to arm the movement, after which the display 12 for the next opening time will appear.

2) With the wind key 11 held in a stationary position, wait until the day indicator 28 has flashed four times. The user then turns the key 11 back-and-forth until the microprocessor 32 cycles through "PR-1", "PR-2" and "PR-3" as explained above. Continued back-and-forth rotation is sensed by the microprocessor 32, and the microprocessor 32 then directs the display to display any predetermined verification message that indicate the version of the time lock in operation.

3) The user holds the wind key 11 stationary and after either the verification period of fifteen seconds or, since no changes need to be verified in this mode, after a shortened verification period of, say, five seconds, the microprocessor 32 disarms the movement.

Note that, during the course of the verification mode, the user will be able to confirm that the movement can be armed (step 1), that the microprocessor 32 correctly cycles through the displays for the other modes, the user sees the verification message, and also sees that the movement will disarm.

By simple turning of a single key 11 is thus possible according to the invention not only to set and view the real time and the opening times for the lock 9, but it is also possible to change and cancel these times. The invention allows full control and verification of the required functions of the lock 9 while requiring, mechanically, only a single display 12 and a keyhole through the lock's mounting brackets or surfaces in the vault door.

As with conventional time locks, two or more of the locks according to the invention may be included in a vault door to provide a back-up in case of failure of any one lock, for example because of the battery becoming too weak to drive the system.

We claim:

1. A method for setting and adjusting a programmable time lock solely by a rotatable key, comprising the steps of:

A) arming the lock by turning a key connected to a key position sensor/encoder;
B) setting a displayed system time by turning the key, which is rotatable in a first and second direction;
C) entering the system time by leaving the key stationary for a predetermined acceptance period;
D) sequentially activating on a display day indicator segments corresponding to the seven days of the week;
E) for each displayed day of the week for which the key is kept stationary for the acceptance period, activating the day indicator corresponding to the next day of the week in sequence; and
F) for each displayed day of the week for which the key is moved during display of the corresponding day indicator segment, entering into a memory primary opening time signals corresponding to a displayed hour and minute selected by a sequence of key turns;
G) after entry of the opening time signals into the memory, upon subsequent arming of the lock, displaying the next entered primary opening time;
H) upon sensing motion of the key alternately in the first and second directions during a predetermined Intermediate Opening Mode selection period, displaying an Intermediate Opening Mode-indicating display for a display period, and, if the key is stationary during the display period, executing the following steps:
i) entering an intermediate opening time for the current day of the week;
ii) holding the key stationary for the confirmation period;
iii) if the intermediate opening time is later than the system time for the current day, entering into the memory an intermediate opening time signal corresponding to the intermediate opening time; and
iv) disarming the lock at the intermediate opening time.

2. A method for setting and adjusting a programmable time lock solely by a rotatable key, comprising the steps of:
A) arming the lock by turning a key connected to a key position sensor/encoder;
B) setting a displayed system time by turning the key, which is rotatable in a first and second direction;
C) entering the system time by leaving the key stationary for a predetermined acceptance period;
D) sequentially activating on a display day indicator segments corresponding to the seven days of the week;
E) for each displayed day of the week for which the key is kept stationary for the acceptance period, activating the day indicator corresponding to the next day of the week in sequence; and
F) for each displayed day of the week for which the key is moved during display of the corresponding day indicator segment, entering into a memory primary opening time signals corresponding to a displayed hour and minute selected by a sequence of key turns;
G) after entry of the opening time signals into the memory, upon subsequent arming of the lock, displaying the next entered primary opening time;
H) upon sensing motion of the key alternately in the first and second directions during a predetermined Cancellation Mode selection period, displaying a Cancellation Mode-indicating display for a display period, and, if the key is stationary during the display period, executing the following steps:
i) sequentially displaying entered opening days and opening times while the key is stationary; and
ii) for each displayed and entered opening day for which the key is moved, except a last remaining opening day, cancelling the primary opening time for the displayed day and deactivating the corresponding cursor indicator.

3. A method for setting and adjusting a programmable time lock solely by a rotatable key, comprising the steps of:
A) arming the lock by turning a key connected to a key position sensor/encoder;
B) setting a displayed system time by turning the key, which is rotatable in a first and second direction;
C) entering the system time by leaving the key stationary for a predetermined acceptance period;
D) sequentially activating on a display day indicator segments corresponding to the seven days of the week;
E) for each displayed day of the week for which the key is kept stationary for the acceptance period, activating the day indicator corresponding to the next day of the week in sequence; and
F) for each displayed day of the week for which the key is moved during display of the corresponding day indicator segment, entering into a memory primary opening time signals corresponding to a displayed hour and minute selected by a sequence of key turns;
G) after entry of the opening time signals into the memory, upon subsequent arming of the lock, displaying the next entered primary opening time;
H) upon sensing motion of the key alternately in the first and second directions during a predetermined Daylight Savings Mode selection period, displaying a Daylight Savings Mode-indicating display for a display period, and, if the key is stationary during the display period, executing the following steps:
i) displaying the hour of the system time;
ii) setting an adjusted hour by incrementing the displayed hour by one upon rotation of the key in the first direction and decrementing the displayed hour by one upon rotation of the key in the second direction, whereby the adjusted hour differs from the system time hour by no more than one;
iii) displaying the minute of the system time;
iv) setting an adjusted minute by incrementing the displayed minute upon rotation of the key in the first direction and decrementing the displayed hour upon rotation of the key in the second direction, whereby the adjusted minute differs from the system time hour by no more than fifty-nine; and
v) after setting the adjusted hour and minute, if the key is stationary for the confirmation period, replacing the system hour and minute by the adjusted hour and minute, respectively.

4. A method for setting and adjusting a programmable time lock solely by a rotatable key, comprising the steps of:
A) arming the lock by turning a key connected to a key position sensor/encoder;
B) setting a displayed system time by turning the key, which is rotatable in a first and second direction;

C) entering the system time by leaving the key stationary for a predetermined acceptance period;

D) sequentially activating on a display day indicator segments corresponding to the seven days of the week;

E) for each displayed day of the week for which the key is kept stationary for the acceptance period, activating the day indicator corresponding to the next day of the week in sequence; and F) for each displayed day of the week for which the key is moved during display of the corresponding day indicator segment, entering into a memory primary opening time signals corresponding to a displayed hour and minute selected by a sequence of key turns;

G) after entry of the opening time signals into the memory, upon subsequent arming of the lock, displaying the next entered primary opening time;

H) upon sensing motion of the key alternately in the first and second directions during a predetermined Verification Mode selection period, displaying a Verification Mode-indicating display corresponding to a predetermined version message for the programmable time lock.

* * * * *